US007716776B2

(12) United States Patent
Bonnell et al.

(10) Patent No.: US 7,716,776 B2
(45) Date of Patent: May 18, 2010

(54) FLAT MOP FOR USE WITH WIPERS FOR CONTROLLED ENVIRONMENTS

(75) Inventors: Karen F. Bonnell, Montvale, NJ (US); Jeffrey J. Tyrrell, Hewitt, NJ (US); Bradley T. Lyon, Winston-Salem, NC (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/052,240

(22) Filed: Mar. 20, 2008

(65) Prior Publication Data

US 2008/0256736 A1 Oct. 23, 2008

Related U.S. Application Data

(60) Provisional application No. 60/912,631, filed on Apr. 18, 2007.

(51) Int. Cl.
*A47L 13/24* (2006.01)
*A47L 13/46* (2006.01)

(52) U.S. Cl. ..... 15/228; 15/144.2; 15/231

(58) Field of Classification Search ..... 15/144.2, 15/147.1, 228, 231, 232
See application file for complete search history.

(56) References Cited

U.S. PATENT DOCUMENTS 1,991,693 A * 2/1935 Oberti ..... 15/231
1,998,634 A * 4/1935 Oberti ..... 15/231
2,870,475 A * 1/1959 Scheuer et al. ..... 15/231
4,225,998 A 10/1980 Thielen
5,915,437 A 6/1999 Petner
6,058,552 A * 5/2000 Hanan ..... 15/228
6,202,250 B1 * 3/2001 Kenmochi et al. ..... 15/231

(Continued)

FOREIGN PATENT DOCUMENTS

FR 1442143 6/1966

(Continued)

OTHER PUBLICATIONS

International Search Report for PCT/US2008/058542.

*Primary Examiner*—Randall Chin
(74) *Attorney, Agent, or Firm*—Levenfeld Pearlstein, LLC

(57) ABSTRACT

A flat mop is used with a disposable wiper. The mop includes a base member having an upper surface and a lower surface. The base member has a projecting securing elements disposed on opposing sides of the upper surface. At least one resilient clip is associated with securing element. A pivot joint has a first receiving portion for mounting to the base member to define a first pivot axis. The pivot joint has a second receiving portion distinct from the first receiving portion and includes an engagement member received in the second receiving portion to defining a second pivot axis spaced from and perpendicular to the first pivot axis. The engagement member includes a coupling portion to mount to a handle. The pivot joint is mounted to the base member for pivoting the base member relative to the pivot joint about two axes. The associated wiper is secured to the base member, positioned on the lower surface of the base member, wrapped around the base member and over the securing elements. The clips are positioned over the associated wiper, on a respective one of the securing elements to secure the wiper to the base member.

6 Claims, 4 Drawing Sheets

U.S. PATENT DOCUMENTS

| | | | | |
|---|---|---|---|---|
| 6,493,899 | B1 * | 12/2002 | Hintz et al. | 15/231 |
| 6,651,290 | B2 * | 11/2003 | Kingry et al. | 15/231 |
| 7,290,305 | B1 * | 11/2007 | Auchmoody | 15/231 |
| 2004/0244133 | A1 | 12/2004 | Li | |

FOREIGN PATENT DOCUMENTS

| | | |
|---|---|---|
| JP | 10155714 | 6/1998 |

* cited by examiner

FLAT MOP FOR USE WITH WIPERS FOR CONTROLLED ENVIRONMENTS

BACKGROUND OF THE INVENTION

The present invention is directed to a mop system. More particularly, the present invention pertains to a controlled environment mop system that uses disposable cleaning elements or wipers.

Many of today's high technology and medical-related processes and functions are required to be carried out in controlled environments or even in clean room settings. For example, the manufacture and fabrication of precision instrument or electronics parts are be carried out in highly controlled environments or cleanrooms. Likewise, the production of pharmaceuticals or manufacture of medical instruments often require controlled environments as well.

Due to the required levels of cleanliness, conventional methods for cleaning industrial and manufacturing facilities may not be sufficient. Many such conventional cleaning devices and methods are not well suited for use in these controlled environments.

Mops are used in many cleaning programs to wipe counters, floors, walls and other larger, flat areas. One known mop device uses a flat pad to which a disposable wiper is attached. A typical attachment includes what are commonly referred to as "star" holders. In such a holder, multiple flexible (typically plastic) fingers extend inward of an opening and "grab" the wiper material to secure the material in the holder. While this functions well to secure the wiper to the mop device, it can also generate fibers and the like due to the abrading action of the star fingers on the wiper material. Moreover, debris and contaminants can collect in the star holder openings, thus detracting from the overall hygiene of the cleaning process.

Accordingly, there is a need for a mop system for use in controlled environments that does not generate additional debris in use. Desirably, such a mop system uses known, currently available wipers. More desirably, such a mop system can be used in wet or dry environments and cleaning situations. Most desirably, such a mop system is itself fully cleanable.

BRIEF SUMMARY OF THE INVENTION

A flat mop is used with an associated disposable wiper. The mop includes a rigid base member having an upper surface and a lower surface. The base can be rigid or flexible. The base member has a securing elements, such as a pair of rails or other projections positioned along opposing sides of the upper surface. At least one and preferably a pair of resilient clips are associated with each rail. Preferably, each clip is tethered to the base member or other part of the mop, by a resilient tether.

A pivot joint has a first receiving portion for mounting to a hinge pin on the base member to define a first pivot axis. The pivot joint has a second receiving portion distinct from the first receiving portion and includes an engagement member received in the second receiving portion that defines a second pivot axis spaced from and perpendicular to the first pivot axis. The engagement member includes a coupling portion, such as an internal thread to receive a handle.

The pivot joint is mounted to the base member for pivoting the base member relative to the pivot joint about two axes. The associated wiper or cleaning fabric is secured to the base member, positioned on the lower surface of the base member, wrapped around the base member and over the rails and is held in place by the clips positioned over the wiper, on a respective rail.

In a present mop, a resilient pad can be mounted to the lower surface of the base member. The resilient pad is formed from a polyester foam or similar resilient or flexible material and is secured to the base member by a fastening element.

Preferably, the rigid base member, the clips and the pivot joint are formed from a polymeric material. The material can be an acetal, polypropylene, nylon, stainless steel or other suitable material. These materials tolerate the temperatures that may be used in sterilization processes using steam, ethylene oxide or dry heat.

Because the wipers are held in place using clips, there is no additional debris generated from use. The mop system can use known, currently available wipers or cleaning fabrics and can be used in wet or dry environments and cleaning situations.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
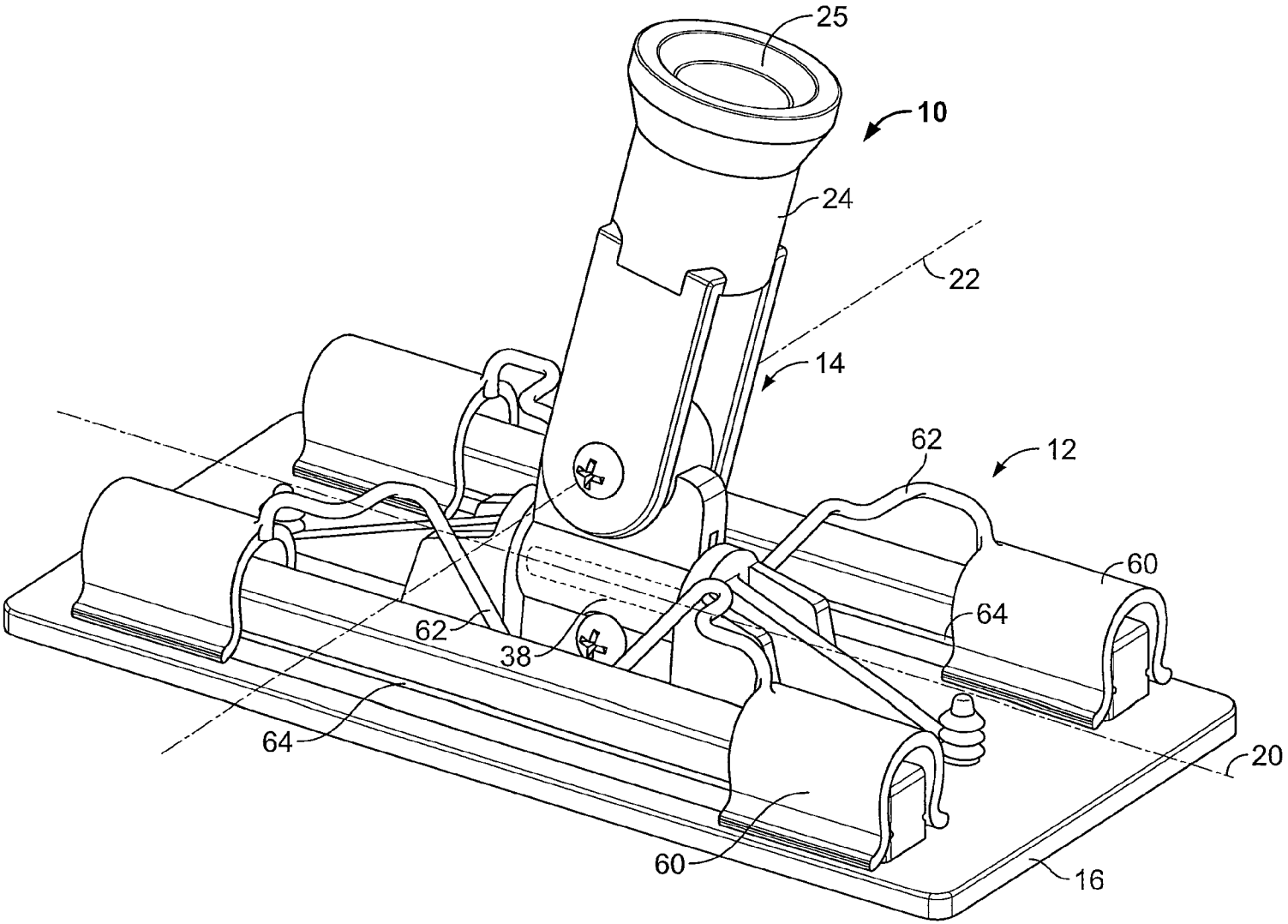
FIG. 1 is a perspective view of a flat mop system for use with wipers embodying the principles of the present invention, the mop being shown without a wiper and a handle for ease of illustration.
Figure 2:
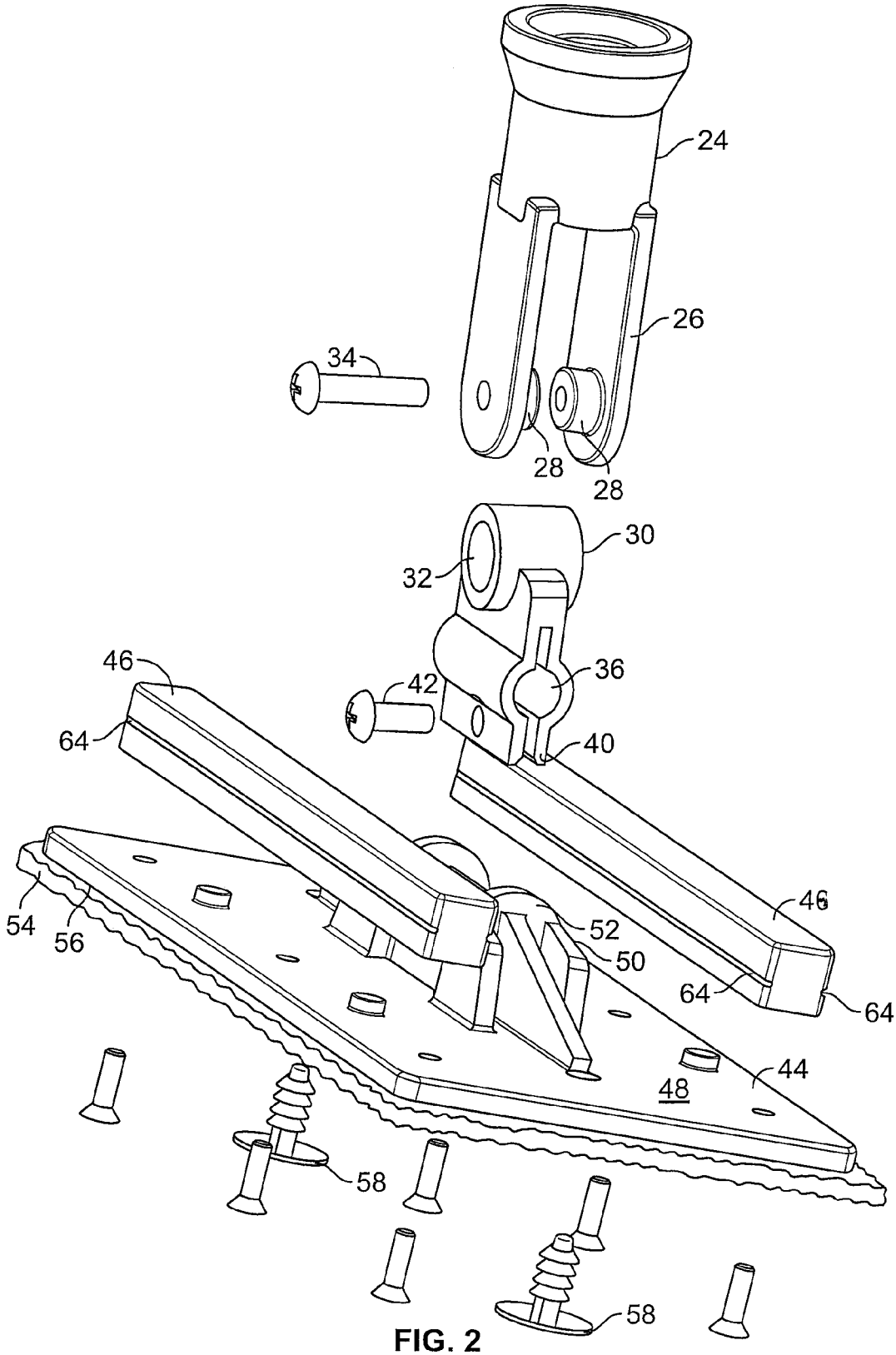
FIG. 2 is an exploded view of the flat mop of FIG. 1.
Figure 3:
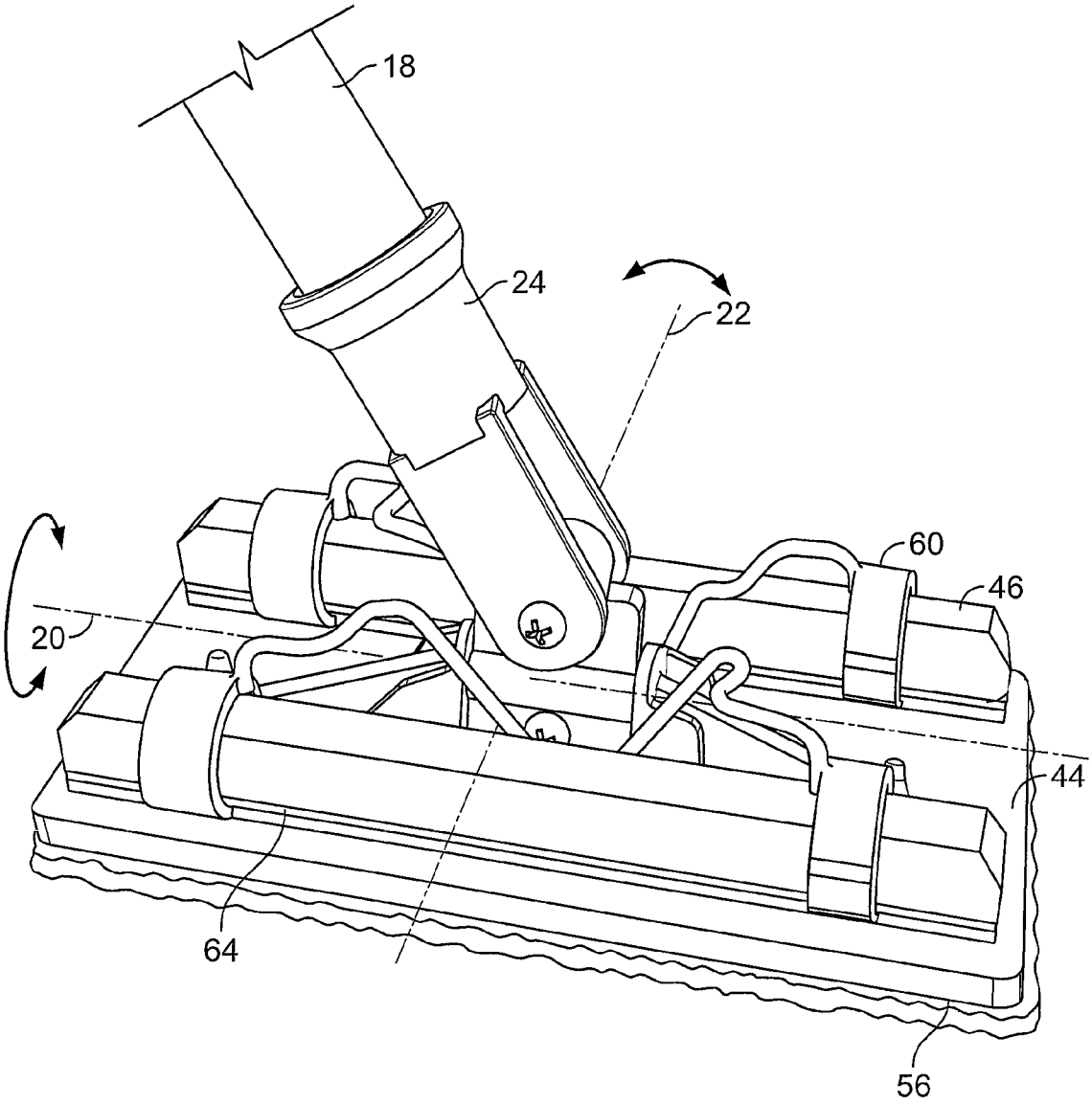
FIG. 3 is a perspective view of the flat mop mounted to a handle.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular to FIG. 1 there is shown a flat mop 10 for use with cleaning fabric or wipers W embodying the principles of the present invention. The flat mop 10 includes a mop head 12 having a swivel joint 14 and a base 16. The swivel joint 14 is configured to permit mounting the head 12 to a handle 18 such that the base 16 can be pivoted in a number of planes (about a number of axes as indicated at 20 and 22).

The swivel or pivot joint 14 includes an engagement member 24, such as the illustrated receiving coupling (having a thread formation 25), into which the handle 18 can be threaded. The coupling 24 includes a depending fork element 26 having inwardly extending pivot pin portions 28 that are engaged in a two pintle receiver 30. The two pintle receiver 30 includes a first receiver 32 having a cylindrical shape, into which the coupling pin portions 28 are inserted to form a first hinge. A fastener 34 such as a bolt can be used to secure the coupling 24 to the receiver 30.

The receiver 30 also includes a second receiver portion 36, which is also cylindrical, that is configured to receive a pin 38 (shown in phantom in FIG. 1) on the base portion 16. The second receiver 36 is oriented perpendicular to the first receiver 32. The second receiver 36 includes an open longitudinal wall 40 that is passed over the base portion pin 38 and is fastened closed by a fastener 42 (to secure the pin 38 therein), such as a threaded bolt or the like. The pivot joint 14 thus provides pivoting movement about two, perpendicular axes 20, 22.

The base portion 16 includes a base member 44 and a pair of rails 46 mounted to an upper surface 48 of thereof. The rails 46 extend along the base member 44, near the edges of the member 44, along a length (longer dimension) thereof. The rails 46 can be mounted to the base member 44 by, for example, bolts, machine screws, rivets, adhesive, moldings, ultrasonic welding or the like. Although elongated, rectangular cross-sectional rails are shown, any shape element or elements that permit securing the wiper W to the mop 10 can be used.

The base member 44 includes a hinge region having the pin 38 that is received in the pivot joint 14, formed as part thereof. The hinge region 50 can include one or more support and/or stop surfaces 52 (e.g., buttresses or structural elements) to provide additional support and strength to the base member 44.

In a present embodiment, the base portion 16 and pivot joint 14 are formed from a rigid material. Although the specific material may need to be determined based upon the specific use and location of the flat mop (e.g., for use in locations having corrosive environments), it is anticipated that polymeric materials such as acetal, polypropylene, polyethylene, rigid nylon, styrene and the like can be used. Other suitable materials include thermoset plastics, thermoplastic resins and silicone. Those skilled in the art will recognize the side variety of materials that are suitable for such applications. Preferably, the material is such that it too can be cleaned and sterilized using steam, ethylene oxide (ETO), dry heat, or like cleaning materials and methods. It will also be appreciated that the base member 44 can be formed from a flexible material.

To assure good contact between the wiper W and the surface that is cleaned, a resilient pad 54 can be mounted to a bottom surface 56 of the base member. The pad 54 can be formed from a resilient/flexible material such as polyester, closed-cell foamed materials or the like. The resilient surface facilitates complete contact of the wiper W with the surface to be cleaned. Moreover, the resilient pad 54 will maintain the wiper W in place and prevent slippage of the wiper W along the base member 44. The pad 54 can be secured to the bottom surface 56 of the base 44 member by, for example, (plastic) push pins 58 or the like. Metal fasteners can also be used.

Figure 4:
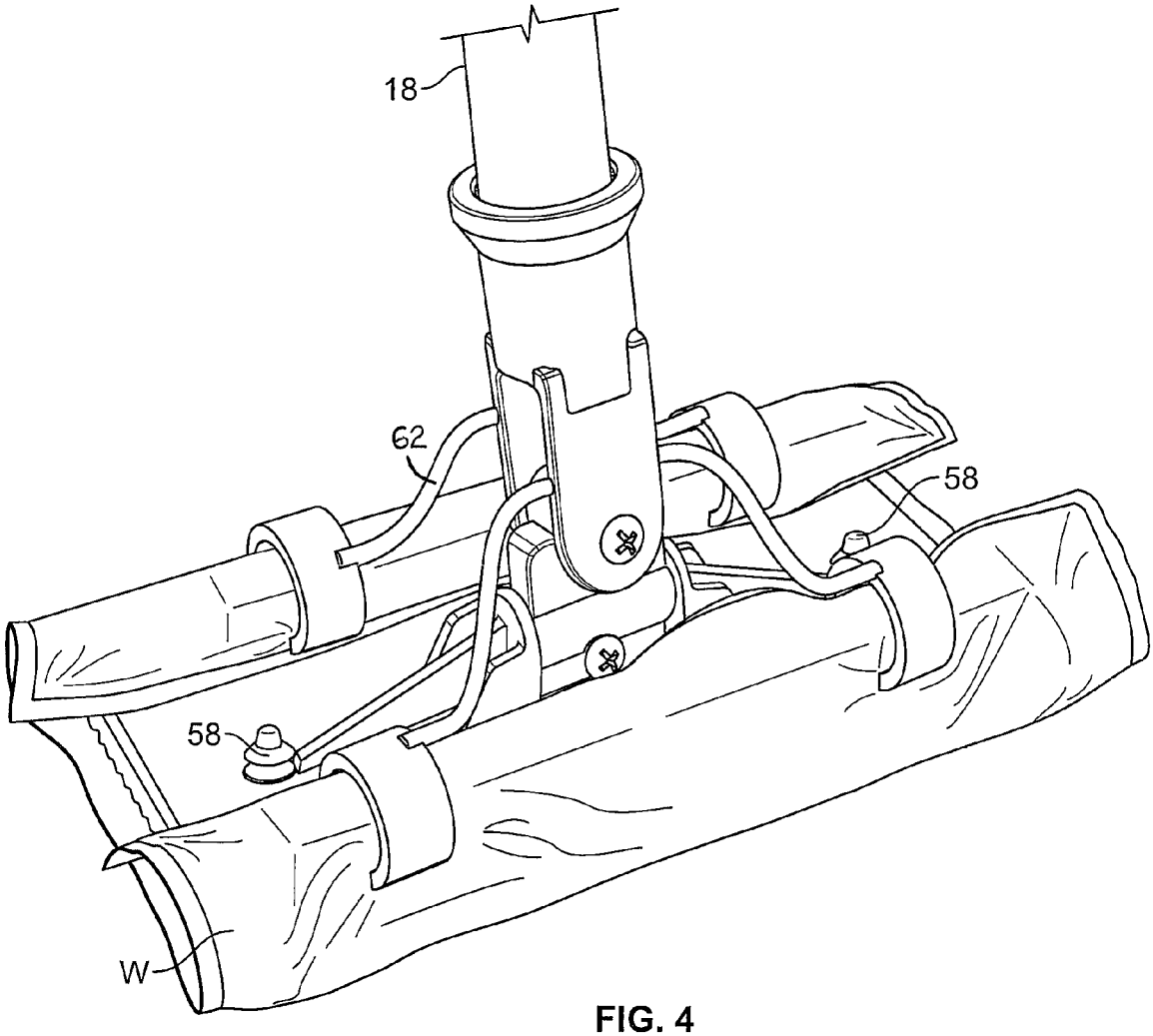
FIG. 4 is a perspective view of the flat mop with a wiper mounted to the mop head.

As seen in the figures, and specifically referring to FIGS. 1 and 4, to secure the wiper W to the base portion 44, the flat mop 10 includes a number of clips 60. The clips 60 fit snuggly (that is, friction fit) over the wiper W and rails 46, to secure the wiper W to the rails 46. As seen in FIG. 4, the wiper W is positioned over the bottom surface 56 of the base member 44 and is wrapped over the rails 46. The clips 60 are then positioned over the wiper W and rails 46 and held in place by the resilient characteristic of the clips 60. Accordingly, the clips 60 are formed from a resilient polymeric material, such as acetal, polypropylene, polyethylene, rigid nylon, styrene or the like. Although four clips 60 are shown, it will be appreciated that any number of clips 60 (preferably at least one per side or rail 46) can be used.

To prevent the clips 60 from becoming misplaced and to provide for ease of replacement of the clips 60, the clips 60 are held to the base portion 16 by tethers 62 (see FIG. 1). The tethers 62 are likewise secured to the base portion 16 to allow the clips 60 to be removed from the rails 46 without fear of being lost. The tethers 62 can be secured to the base portion 16 by, for example, a removable fastener (not shown) to permit the clips 60 and tethers 62 to be removed and replaced from the mop 10. The clips 60 can alternately be tethered to the pivot joint 14 (see, e.g., FIG. 4) or any other part of the mop 10. The rails 16 can include longitudinal grooves 64 into which the clips 60 will snap-fit for a positive lock of the wipe to the mop 10.

It will be appreciated that the present flat mop 10 provides a number of advantages over known mop systems. First, the wipers W are secured to the mop 10 in a manner that does not generate debris (such as wiper fibers). In addition, preferably, the mop 10 is formed from polymer or plastic material, (as compared to metal), and as such the potential for contamination due to rust, metal abrasion, magnetics and general metal particle shredding are eliminated. Moreover, the present clip 60 design permits the mop 10 to be loaded with multiple wipers W which can then be removed, one at a time, after use.

It will be appreciated that although the present flat mop system 10 is disclosed and discussed for use in controlled environments, it can be used in most any and all cleaning applications from cleanrooms to laboratories, hospitals, general commercial, industrial and residential facilities. It will also be appreciated that the present flat mop system 10 can be used in both dry and wet applications. It will further be appreciated that many parts that are described as attached, welded or the like can be formed molded to their respective attached parts, and conversely many parts that are described as molded with another part can be separately formed and attached, as by welding, fasteners or the like.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A flat mop-comprising:

a disposable wiper;

a base member, the base member having an upper surface and a lower surface, the base member having a pair of rails extending along opposing sides of the upper surface, the base member having a mount having a hinge pin thereon;

a pair of resilient clips associated with each rail, each clip being connected to the base member by a resilient tether; and a pivot joint having a first receiving portion for receiving the base member hinge pin for mounting the base member thereto, the pivot joint defining a first pivot axis, the pivot joint having a second receiving portion distinct from the first receiving portion, the pivot joint including an engagement member received in the second receiving portion and defining a second pivot axis spaced from and perpendicular to the first pivot axis, the engagement member including a coupling portion;

wherein the pivot joint is mounted to the base member for pivoting the base member relative to the pivot joint about two axes, and where the disposable wiper is secured to the base member, positioned on the resilient pad, wrapped around the base member and over the rails, and wherein the clips are positioned over the disposable wiper, on respective rails to secure the wiper thereto and wherein the rail has a groove formed therein for receiving a respective clip.

2. The flat mop in accordance with claim 1 including a resilient pad mounted to the lower surface of the base member.

3. The flat mop in accordance with claim 2 wherein the resilient pad is formed from a polyester foam material.

4. The flat mop in accordance with claim 1 wherein the engagement member coupling portion has an internal thread formation.

5. The flat mop in accordance with claim 1 wherein the base member, the clips and the pivot joint are formed from a polymeric material.

6. The flat mop in accordance with claim 5 wherein the polymeric material is an acetal, polypropylene, nylon, thermoset plastic, thermoplastic resin or silicone.

* * * * *